United States Patent [19]

Blackman

[11] 4,141,585

[45] Feb. 27, 1979

[54] FOLDING COOLING LOUNGE CHAIR

[76] Inventor: Wynona Blackman, 792 Columbus Ave., New York, N.Y. 10025

[21] Appl. No.: 843,585

[22] Filed: Oct. 19, 1977

[51] Int. Cl.[2] ..... A47C 7/02

[52] U.S. Cl. ..... 297/180; 297/16; 297/453

[58] Field of Search ..... 62/312, 313, 261, 262, 62/259, 316; 5/284, 347, 362, 352; 128/376, 377; 297/180, 16, 17, 453, 217

[56] References Cited

U.S. PATENT DOCUMENTS

| | | | |
|---|---|---|---|
| D. 116,558 | 9/1939 | Ficks | 297/17 X |
| 577,233 | 2/1897 | Burger | 128/377 |
| 1,817,277 | 8/1931 | Uhlig | 128/376 X |
| 1,936,960 | 11/1933 | Bowman | 5/347 |
| 2,493,067 | 1/1950 | Goldsmith | 5/347 |
| 2,528,768 | 11/1950 | Marsh | 5/352 X |
| 2,782,834 | 2/1957 | Vigo | 62/261 X |
| 2,976,700 | 3/1961 | Jackson | 62/313 |
| 3,625,434 | 12/1971 | Kitover | 280/180 |

*Primary Examiner*—James T. McCall
*Attorney, Agent, or Firm*—Leonard W. Suroff

[57] ABSTRACT

A cooling chair comprising a seat rest having a first chamber therein and a back rest having a second chamber therein communicating with the first chamber. The chambers each have a closed end and a spaced apart porous end having a plurality of vents and adapted to receive a coolant therein, such as dry ice or the like, for use in cooling the lounge chair. A door is mounted relative to one of the chambers to permit the insertion of the coolant therein. Front supporting legs are operatively connected to the seat rest, with rear supporting legs operatively connected to the back rest. A battery compartment in one of the chambers for storing a battery is provided with access means to the battery compartment so as to permit replacement of the battery from time to time. An electric fan is mounted in one of the chambers adjacent a closed end thereof for creating a flow of air through the chambers so as to provide a flow of air over the coolant and exiting from the chamber through the vents, with guard means enclosing the electric fan, and a timer electrically coupled to the electric fan and a battery in the battery compartment so as to obtain circulation of air in the chambers by the electric fan for controlled periods of time, such that cool air is forced through the vents to cool a person on the chair.

16 Claims, 8 Drawing Figures

FOLDING COOLING LOUNGE CHAIR

BACKGROUND OF THE INVENTION

1. Field of the Invention

The present invention relates to a chair and more particularly one having the type of structure in that a cooling system is incorporated therein for the comfort of the person using the chair.

2. Description of the Prior Art

It has been appreciated in the prior art that a seat or chair structure that is self-cooling would be advantageous and a comfort for the person utilizing same. Structures of this type in the prior art are generally illustrated in U.S. Pat. Nos. 2,976,700 and 3,295,886. The present inventor has found that the need exists for a chair, which may be in the form of a lounge, in which all of the components are contained therein and which chair may be readily folded for storage or transportation.

OBJECTS OF THE INVENTION

An object of the present invention is to provide a chair structure which has associated therewith a coolant such as dry ice, to provide in conjunction with a fan a means of cooling the user thereon.

Another object of the present invention is to provide a compactible and portable chair which provides refreshing cool air to the user thereof.

Other objects and advantages of the present invention will become apparent as the disclosure proceeds.

SUMMARY OF THE INVENTION

A cooling chair comprising a seat rest having a first chamber therein and a back rest having a second chamber therein communicating with the first chamber. The chambers each have a closed end and a spaced apart porous end having a plurality of vents and adapted to receive a coolant therein, such as dry ice or the like, for use in cooling the lounge chair. A door is mounted relative to one of the chambers to permit the insertion of the coolant therein.

Front supporting legs are operatively connected to the seat rest, with rear supporting legs operatively connected to the back rest. A battery compartment in one of the chambers for storing a battery is provided with access means to the battery compartment so as to permit replacement of the battery from time to time.

An electric fan is mounted in one of the chambers adjacent a closed end thereof for creating a flow of air through the chambers so as to provide a flow of air over the coolant and exiting from the chamber through the vents, with guard means enclosing the electric fan, and a timer electrically coupled to the electric fan and a battery in the battery compartment so as to obtain circulation of air in the chambers by the electric fan for controlled periods of time, such that cool air is forced through the vents to cool a person on the chair.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
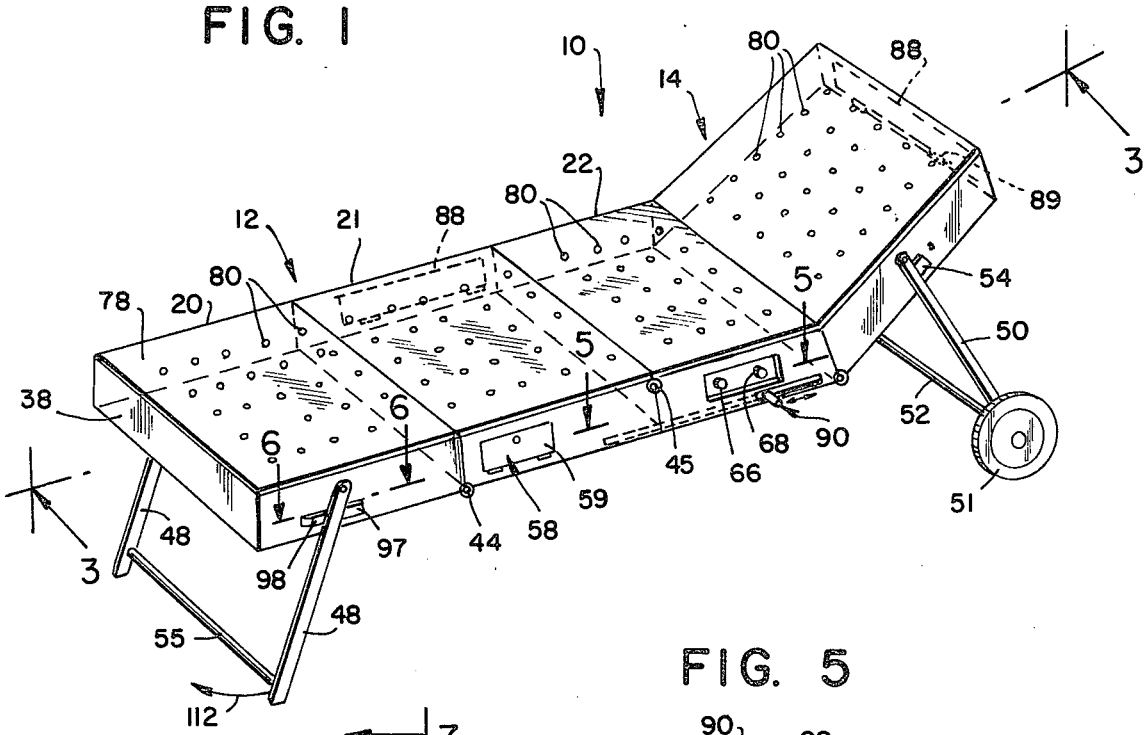
FIG. 1 is a perspective view of the cooling chair in accordance with the present invention.

Referring to the drawings in detail, there is illustrated in FIGS. 1 through 8 a cooling chair 10 that is adapted to be utilized by the user during summer months primarily, in which the user desires to cool his or her body. The cooling chair 10 may be in the form of a lounge chair and is illustrated in its open position in FIG. 1 and in its closed folded position in FIG. 2 for storage. Accordingly, the chair 10 is readily transportable by the user and easily stored during the winter months.

Figure 3:
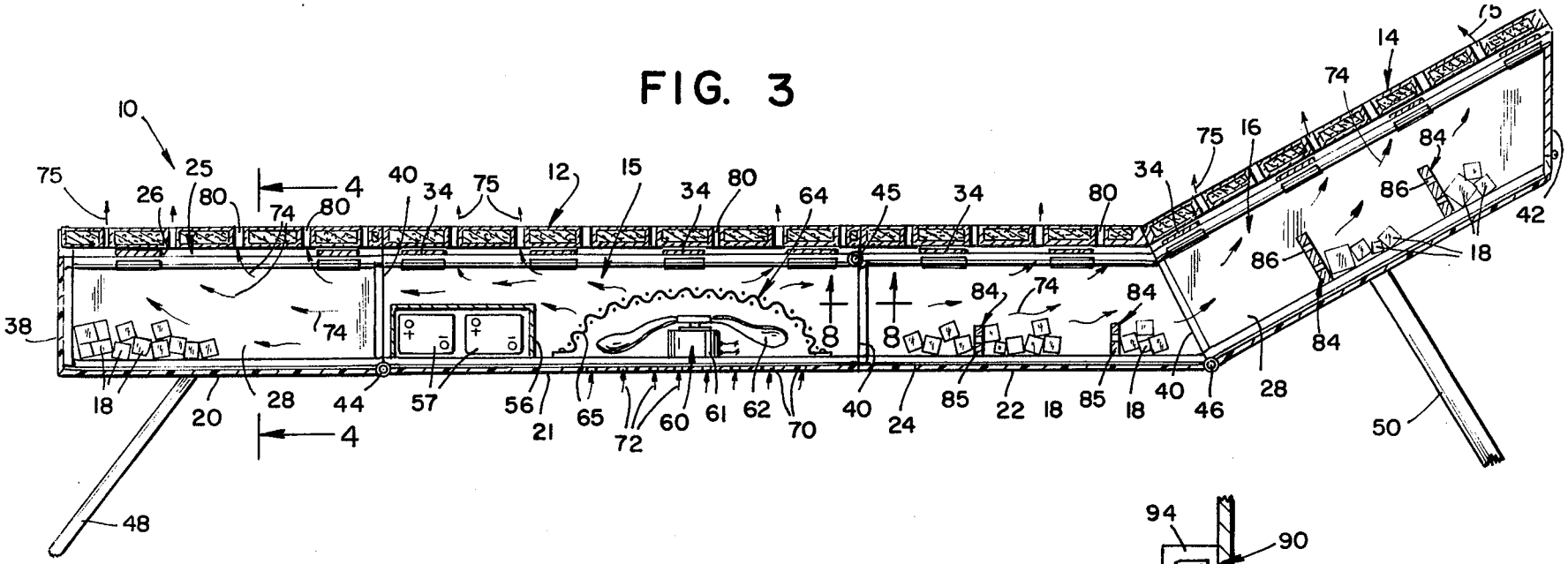
FIG. 3 is a sectional view taken along lines 3—3 of FIG. 1.

The cooling chair 10 may include a seat rest 12 and a back rest 14 that operate in conjunction with each other. The seat rest 12 may have a first chamber 15 contained therein, as illustrated in FIG. 3. The back rest may have a second chamber 16 formed therein. The chambers 15 and 16 are adapted to have placed therein a coolant 18 which may be in the form of dry ice or the like for use in cooling the lounge chair 10 in a manner hereinafter described in detail.

The seat rest 12 in order to be foldable may include a first section 20, second section 21 and third section 22. The first chamber 15 may extend throughout the sections 20–22. Each section 20–22 includes a closed end 24 and a spaced apart porous end 25 which has a plurality of vents 26 contained therein. The vents 26 permit the flow of air to the exterior of the cooling chair 10 along the porous end 25.

Each section 20–22 further includes a pair of spaced apart side walls 28 extending substantially vertically between the porous end 25 and the closed end 24, as illustrated in FIG. 3. To support the side walls 28, the structure of each section 20–22, as well as the back rest 14, may include a pair of lower horizontally extending tubular support members 30 and a pair of upper horizontally extending tubular support members 32. The side walls 28 connect the upper and lower support members 30 and 32, respectively. The side walls 28 and support members 30 and 32 may be fabricated from a light weight material such as aluminum or plastic.

Figure 4:
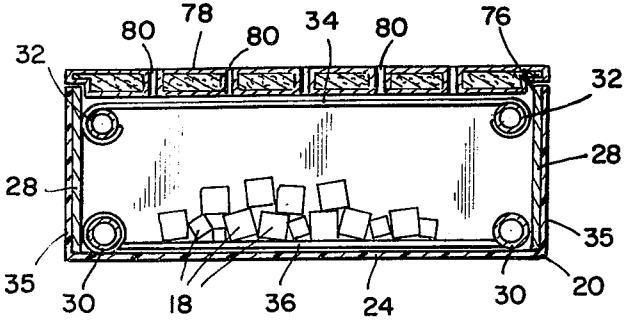
FIG. 4 is a sectional view taken along lines 4—4 of FIG. 3.

The rests 12 and 14 may include a plurality of spaced apart straps 34 extending transversely between the side walls 28, and preferably supported by the upper support members 32, as illustrated in FIG. 4. The straps 34 may be of a flexible material and capable of supporting the weight of the user thereon. The straps 34, because of their spacing, define the vents 26 of the porous end 25. This spacing is sufficient to permit cool air to pass therethrough. In surrounding relationship to the side walls 28, there may be provided plastic outer walls 35 that may be an extension of the closed end 24.

A platform 36 may be provided to extend horizontally across the width of the rests 12 and 14 in order to provide a support surface for the coolant 18, which is illustrated in the form of cubes.

In order to permit the proper flow of air through the rests 12 and 14, the first section 20 is provided with a closed end 38 which forms the front of the chair 10 and an oppositely disposed open end 40. The second section 21 is formed having a pair of oppositely disposed open ends 40, as is the third section 22. The back rest 14 includes a closed end 42 and an oppositely disposed open end 40. In this manner each of the open ends 40 are in communication with each other so as to readily permit a flow of cool air through the vents 26 as the air flows between chambers 15 and 16.

To permit the folding of the respective sections 20–22, as well as the back rest 14, relative to each other, there is also provided first coupling means 44 for pivotally joining the first section 20 and second section 21. The first coupling means 44 is mounted at the closed end 24 and permits sections 20 and 21 to be folded in the manner illustrated in FIG. 2. Second coupling means 45 is provided for pivotally joining sections 21 and 22 together at substantially the porous end 25 thereof. In addition, third coupling means 46 is provided for pivotally joining the third section 22 to the back rest 14 at substantially the closed end 24.

Figure 2:
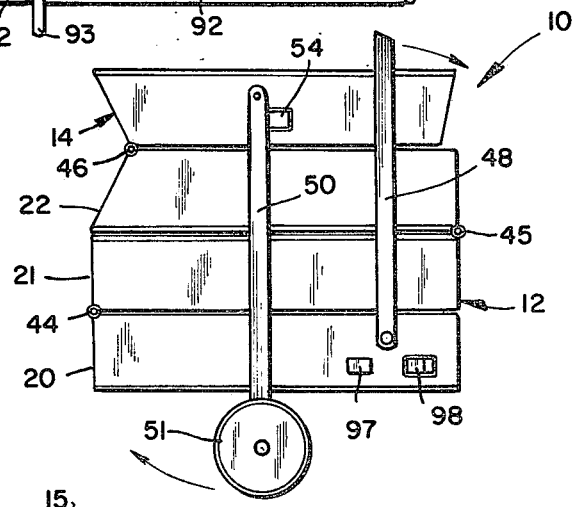
FIG. 2 is a side view illustrating the chair of FIG. 1 in its folded position.

The coupling means 44–46 may be in the form of one or more hinges mounted in a conventional manner such that the sections 20–22 and the back rest 14 may be folded into the overlapping position illustrated in FIG. 2. In this closed position the chair 10 is readily transportable since there is provided front supporting legs 48 and rear supporting legs 50. The rear supporting legs 50 may be pivotally connected to the back rest 14 and have wheels 51 associated therewith.

In this manner in the folded position the wheels 51, which may be mounted on an axle 52, can be used for movement of the folded chair 10. A clip 54 may be mounted on each side wall 28 to limit the rearward movement of each supporting leg 50. It is appreciated that the sections 20–22 are readily opened to the position illustrated in FIG. 1, at which time the legs 48 and 50 provide the necessary support. Legs 48 may have a cross member coupling them together.

The chair 10 is designed to be self-contained in that a battery compartment 56 may be provided within the first chamber 15, as illustrated in FIG. 3. The battery compartment 56 may contain one or more batteries 57 that may be inserted or removed by access means 58 associated with the side wall 28 of one of the sections 20–22. The access means may be in the form of a panel 59 which is mounted to be removed to gain access to the batteries 57.

An electric fan 60 is mounted within either chamber 15 or 16 adjacent the closed end 24 for creating a flow of air through the chambers 15 and 16 so as to provide a flow of air over the coolant 18 which exits from the chambers 15 and 16 through the vents 26. The electric fan 60 may include an electric motor 61 and a fan blade 62 coupled thereto. To prevent coolant 18 from engaging the fan blade 62, there is provided guard means 64 enclosing the electric fan 60. The guard means 64 may include a fine mesh screen 65, as illustrated in FIG. 3, enclosing the electric fan 60. Although a battery is preferable, the electric fan 60 may be powered from a conventional electric outlet by means of an electric cord (not shown) coupled to the electric motor 61, in which case the battery would not be utilized. A thermostat may be coupled to the electric fan 60 to control when it is energized.

As illustrated in FIG. 1, to provide the desired controls, there may be included a timer 66, of conventional design, electrically coupled to the electric fan 60 and batteries 57 so as to obtain circulation of air in chambers 15 and 16 for controlled periods of time. There may also be provided a power switch 68 mounted adjacent to the timer 66 so as to permit the user to first turn on the electric current from the batteries 57 to the timer 66. The electrical interconnection can be accomplished in a manner well known in the art.

At such time as the electric fan 60 is energized, rotation of the fan blade 62 will occur, and in order to permit an intake of fresh air into the chambers 15 and 16, there may be provided a plurality of intake openings 70, as illustrated in FIG. 3, behind the fan 61. The intake openings 70 may extend through the closed end wall 24. This creates a suction force with an air flow illustrated by arrows 72, which in turn creates an air flow through the chambers 15 and 16, as illustrated by arrows 74. This in turn results in the air flowing across the coolant 18 and becoming cooled prior to exiting through the vents 26. Upon exiting the chair 10, as illustrated by arrows 75, the person being supported on the chair 10 will have cool air being forced against his or her body.

This air movement will continue for the period of time for which the timer 66 is set. This will vary per individual as to the amount of time he or she desires to have the cool air illustrated by arrows 75 flowing across their body.

The side walls 28 may extend above the upper support members 32 such that a seat or recess 76 is provided, as illustrated in FIG. 4. A cushion or mattress 78 may be positioned in the seat in a removably mounted manner. The cushion 78 extends in overlapping relationship to the straps 34 and may include a plurality of apertures 80 extending therethrough. The apertures are designed to permit passage of the cooled air exiting from the vents 26 to pass through the apertures 80.

In this manner the user may be situated on a cushion 78 that provides a most comfortable seating arrangement and yet permits the flow of cooled air to reach his or her body. The cushion 78 may be fabricated from a variety of materials such that it is readily washable if so desired.

Figure 8:
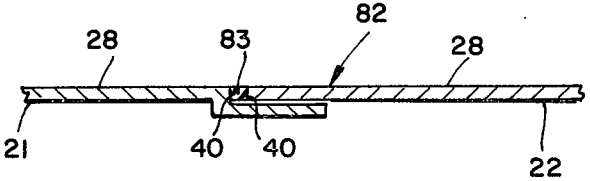
FIG. 8 is a sectional view taken along lines 8—8 of FIG. 3.

In view of the fact that there may be an accumulation of moisture within the chambers 15 and 16, there is provided sealing means 82, as illustrated in FIG. 8. The sealing means may include a gasket 83 extending adjacent to the open ends 40 of the respective sections 20–22 and back rest 14. In this manner moisture accumulation may be readily confined and contained within the chambers 15 and 16 until such time as the chair 10 is emptied of its coolant 18.

To maintain the coolant 18 in its respective areas, there may be provided separating means 84, as illustrated in FIG. 3. The separating means 84 may include vertically extending panels 85 extending upwardly from the closed end 24. The panels 85 may have openings 86 therein to permit an accumulation of moisture in the back rest 14 to flow into the first chamber 15.

In order to provide for the insertion of the coolant 18 into chambers 15 and/or 16, there may be provided one or more doors 88, as illustrated in FIG. 1. Each door 88 may be mounted as by a hinge 89 or by some other mounting arrangement. This permits the user prior to use of the chair 10 to insert a supply of coolant therein. It is appreciated that a door 88 may be provided with each section 20–22, as well as the back rest 14. In this manner after the chair 10 is no longer being used, the coolant 18 may be removed from chambers 15 and 16.

Figure 5:
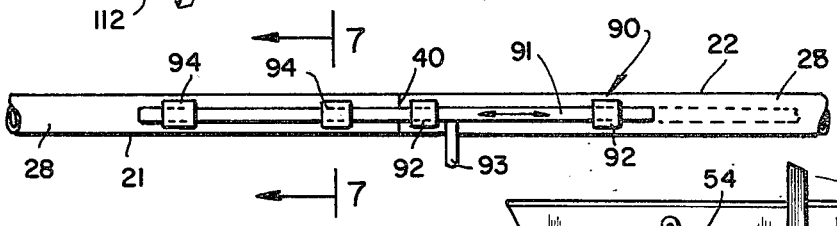
FIG. 5 is a sectional view taken along lines 5—5 of FIG. 1.
Figure 7:
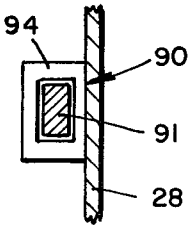
FIG. 7 is a sectional view taken along lines 7—7 of FIG. 5.

In order to retain the sections 21 and 22 in their fixed position, there is provided locking means 90, which is particularly illustrated in FIGS. 5 and 7. The locking means 90 is utilized for releasably coupling the sections 21 and 22 together and includes a latch member 91 mounted on each of the side walls 28 for reciprocal movement between an extended position, as illustrated in FIG. 5, to a retracted position, as illustrated by the broken lines in FIG. 5.

Each latch member 91 in its extended position is utilized for bridging the adjacent open ends 40 of sections 21 and 22 such that there is an interconnecting therebetween. The latch member 91 in its retracted position being disposed inwardly of the free ends 40 of the section it is mounted on. The latch member 91 may be mounted in a support element 92 and have a handle 93 extending therefrom. At least one sleeve 94 is mounted on each one of the corresponding side walls 28 in longitudinal alignment with the latch member 91 and adapted to receive therein in bridging relation the latch member 91 in the open position of the chair.

In this manner the sections 21 and 22 are readily joined together by the locking means 90 so as to permit assembly of the chair 10 in a convenient and easy manner by the user thereof. The chair 10 is also provided with the front supporting legs 48 pivotally mounted to the spaced apart side walls 28. Retaining means 96 is utilized for securing the front supporting legs 48 in a fixed position when the chair 10 is in its open position and permitting movement to an inverted position in the closed position of the chair, as illustrated in FIG. 2.

The retaining means includes a fixed stop 97 extending to one side of the leg 48, outwardly from the wall 28 of the section 21. A catch 98 having a rear surface 100 and a front surface 102, is mounted at one end thereof 104 as by a hinge 105. In this manner the catch 98 is secured to the inside of side wall 28 and extends through an opening 106 so as to be adjacent to a leg 48. In this manner the leg 48 is nested between the stop member 97 and the catch 98.

Figure 6:
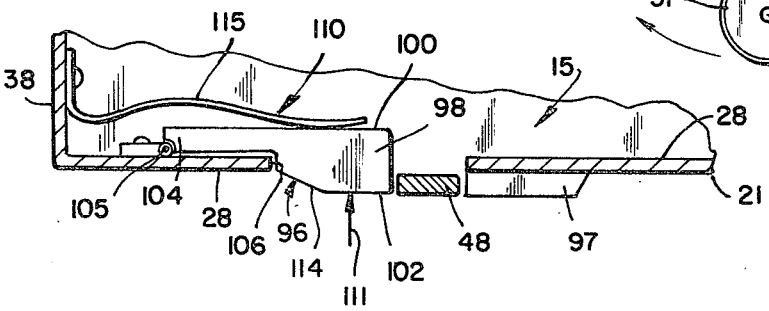
FIG. 6 is a sectional view taken along lines 6—6 of FIG. 1.

Mounting means 110 is operatively associated with each catch 98 for releasably retaining the catch 98 in its normally outwardly extending position, as illustrated in FIG. 6. The mounting means 110 permitting the catch 98 to be inwardly depressed in the direction of arrow 111, and into the first chamber 15. When the catch 98 is depressed sufficiently, the legs 48 may be angularly rotated in the direction of arrow 112. This rotation will take place when the chair 10 is to be folded into its closed position. The catch 98 may have a tapered forward portion 114 such that when the leg 48 engages same, it automatically forces catch 98 inwardly.

The mounting means 110 includes the hinge 105 and a spring arm 115 mounted in chamber 15 in operative relation to the rear surface or side 100 of the catch 98 so as to normally retain the catch 98 in its extending position. The spring arm 115 may be secured to the closed end 38 and be of a leaf-type construction such that when the catch 98 pivots about hinge 105, the catch 98 may be inwardly disposed a sufficient distance to release and permit movement of legs 48.

Accordingly, there has been disclosed a chair 10 which is both portable in that the energy required to power same is self-contained. The user may transport the chair 10 or store same as required. The air cooling capacity of the chair may be varied by the amount of coolant 18 contained therein. At the same time the chair 10 is light weight and may be readily transported.

Although an illustrative embodiment of the invention has been described in detail herein with reference to the accompanying drawings, it is to be understood that the invention is not limited to the precise embodiment and that various changes and modifications may be effected therein without departing from the scope or spirit of the invention.

I claim:

1. A cooling chair comprising:

A. a seat rest having a first chamber therein,

B. a back rest having a second chamber therein communicating with said first chamber, C. said chambers each having a closed end and a spaced apart porous end having a plurality of vents and adapted to receive a coolant therein, such as dry ice or the like, for use in cooling the lounge chair, D. a door mounted relative to one of said chambers to permit the insertion of the coolant therein, said coolant adapted to be supported on said closed end of said chambers, E. front supporting legs operatively connected to said seat rest, F. rear supporting legs operatively connected to said back rest, G. a battery compartment in one of said chambers for storing a battery, H. access means to said battery compartment so as to permit replacement of said battery from time to time, I. an electric fan mounted in one of said chambers adjacent a closed end thereof for creating a flow of air through said chambers so as to provide a flow of air over said coolant and exiting from said chamber through said vents, J. guard means enclosing said electric fan, K. a timer electrically coupled to said electric fan and a battery in said battery compartment so as to obtain circulation of air in said chambers by said electric fan for controlled periods of time, such that cool air is forced through said vents to cool a person on the chair, L. said seat rest includes:

(1) a first section, (2) a second section, (3) a third section, (4) first coupling means for pivotally joining said first section to said second section at said closed end thereof, so as to permit said first section and said second section to be folded between an open position to a closed position in which said first and second sections are in overlapping relationship to each other, (5) second coupling means for pivotally joining said second section to said third section at said porous end thereof, so as to permit said second section and said third section to be folded between an open position to a closed position in which said second and third sections are in overlapping relationship to each other, and (6) third coupling means for pivotally joining said third section to said back rest at said closed end thereof, so as to permit said third section and said back rest to be folded between an open position in which said back rest is inclined relative to said third section to a closed position in which said third section and said back rest are in overlapping relationship to each other, M. locking means associated with said second and third sections for releasably coupling same together in the open position of the chair, N. said sections each include (7) a pair of spaced apart side walls extending substantially vertically between said porous end and said closed end, and (8) at least one open end on each one of said sections, and O. said locking means includes (9) a latch member mounted on each one of said side walls of said second or third sections for reciprocal movement between extended and retracted positions, in extended position bridging the adjacent open ends of said second and third sections for interconnecting the latter, said latch member in the retracted position being disposed inwardly of said free end of the one of said sections it is mounted on, and

(10) a sleeve mounted on each one of the corresponding one of said side walls in longitudinal alignment with said latch member and adapted to receive therein in bridging relation said latch member in the open position of the chair.

2. A cooling chair as defined in claim 1, wherein said guard means includes a screen extending over said electric fan so as to prevent said coolant from engaging said electric fan.

3. A cooling chair as defined in claim 2, wherein said electric fan includes an electric motor and a fan blade coupled thereto.

4. A cooling chair as defined in claim 1, including a power switch mounted on one of said rests to be electrically coupled to a battery in said battery compartment for controlling the electric current to said timer.

5. A cooling chair as defined in claim 1, a handle extending from said latch member to facilitate said reciprocal movement between said positions.

6. A cooling chair as defined in claim 1, wherein:

a. said front supporting legs are pivotally mounted to said spaced apart side walls, and b. retaining means for securing said front supporting legs in a fixed position when the chair is in its open position and permitting movement to an inverted position in the closed position of the chair.

7. A cooling chair as defined in claim 6, wherein said retaining means includes:

a. a fixed stop member extending outwardly from said side walls of each of said first section, b. a catch mounted at one end thereof and outwardly extending from each one of said side walls in spaced relationship to said stop member with each one of said front legs adapted to extend between said stop member and said catch in the open position of the chair, and c. mounting means operatively associated with each said catch for releasably retaining said catch in its normally outwardly extending position, said mounting means permitting said catch to be inwardly depressed into said first chamber so as to permit said legs to be angularly rotated relative to said seat rest when the chair is folded into its closed position.

8. A cooling chair as defined in claim 7, wherein said mounting means includes:

a. a hinge pivotally mounting each said catch at substantially one end thereof, and b. a spring arm mounted in said first chamber in operative relation to each said catch at one side thereof so as to normally retain said catch in its extending position, said catch being depressable in order to permit said leg associated therewith to be rotated relative to said first section.

9. A cooling chair as defined in claim 1, wherein:

a. said first section has a closed end forming the front of the chair and an oppositely disposed open end, b. said second section has a pair of oppositely disposed open ends, c. said third section has a pair of oppositely disposed open ends, d. said back rest includes a closed end forming the rear of the chair and an oppositely disposed open end, and e. said open ends are each in communication with each other so as to permit a flow of cool air through said vents on said porous end.

10. A cooling chair as defined in claim 9, wherein said porous end is formed by a plurality of straps extending transversely between said side walls and defining said vent for the cool air to pass therethrough.

11. A cooling chair as defined in claim 10, wherein said chambers of each of said rests include:

a. a pair of upper horizontally extending tubular support members, b. a pair of lower horizontally extending tubular support members, c. said side walls connecting said upper and lower support members together, d. said closed end extending across one side of said lower support members, and e. said straps extending across said upper support members.

12. A cooling chair as defined in claim 11, said closed end adjacent said fan having intake openings extending therethrough to have a flow of fresh air entering said chambers.

13. A cooling chair as defined in claim 11, wherein said side walls extend above said upper support members to form a seat therein, and a cushion having a plurality of apertures extending therethrough is removably mounted in said seat in overlapping relationship to said straps such that the cooled air flowing across said coolant exits through said vents and then flows through said apertures such that a person on the chair is cooled.

14. A cooling chair as defined in claim 11, including sealing means extending between the adjacent open ends of said sections and said back rest when the chair is in its open position.

15. A cooling chair as defined in claim 11, wherein said sections of said seat rest and said back rest are in overlapping relationship to each other when the chair is in its folded and closed position.

16. A cooling chair as defined in claim 11, including separating means extending in said chambers upwardly from said closed end in order to provide a confinement of said coolant in said chambers in select portions thereof.

* * * * *